US009737176B2

(12) United States Patent
Glaser

(10) Patent No.: US 9,737,176 B2
(45) Date of Patent: Aug. 22, 2017

(54) VESSEL WITH RECESSED SOAP DISH AND INTEGRATED OVERFLOW DRAIN

(71) Applicant: Todd M. Glaser, Miami Beach, FL (US)

(72) Inventor: Todd M. Glaser, Miami Beach, FL (US)

( * ) Notice: Subject to any disclaimer, the term of this patent is extended or adjusted under 35 U.S.C. 154(b) by 226 days.

(21) Appl. No.: 14/687,262

(22) Filed: Apr. 15, 2015

(65) Prior Publication Data

US 2016/0302623 A1 Oct. 20, 2016

(51) Int. Cl.
*A47K 5/04* (2006.01)
*E03C 1/24* (2006.01)

(52) U.S. Cl.
CPC . *A47K 5/04* (2013.01); *E03C 1/24* (2013.01)

(58) Field of Classification Search
CPC ..... A47K 5/04; E03C 1/24
USPC ..... 4/559, 651
See application file for complete search history.

(56) References Cited

U.S. PATENT DOCUMENTS

| | | | | |
|---|---|---|---|---|
| 267,156 A | | 11/1882 | Cooper | |
| 1,821,584 A | | 9/1931 | Schultis | |
| 2,070,010 A | * | 2/1937 | Groeniger | E03C 1/26 4/651 |
| 2,572,463 A | | 10/1951 | Fine | |
| 3,164,356 A | | 1/1965 | Zajaczkowski | |
| 3,283,340 A | | 11/1966 | McMurtrie et al | |
| 4,709,428 A | | 12/1987 | Garcia | |
| 4,719,652 A | * | 1/1988 | Diamond | A47K 5/02 4/559 |
| 5,669,085 A | * | 9/1997 | Wilson | A47K 5/02 4/559 |
| 6,272,699 B1 | | 8/2001 | Peterson | |
| 8,499,375 B2 | | 8/2013 | Kim et al. | |

FOREIGN PATENT DOCUMENTS

| | | | | |
|---|---|---|---|---|
| CA | 2114780 A1 | * | 8/1995 | A47K 5/04 |
| GB | 319119 A | | 9/1929 | |
| RU | 24917 U1 | | 10/2002 | |

OTHER PUBLICATIONS

PCT Written Opinion of the International Searching Authority, PCT/US2016/027083.
PCT International Search Report, PCT/US2016/027083.

* cited by examiner

*Primary Examiner* — Tuan N Nguyen
(74) *Attorney, Agent, or Firm* — Assouline & Berlowe, PA; Loren Donald Pearson

(57) ABSTRACT

A vessel, such as a bathtub or sink, has a soap dish recessed in the inside wall of the vessel. The recessed soap dish is connected to the overflow drain of the vessel. The soap dish is large enough to receive a bar of soap. The overflow drain holes in the bottom of the soap dish are small enough to prevent the bar of soap from falling into the overflow drain. The recessed soap dish can be placed in the front of the vessel so that the soap dish is hidden from view. The front of the sink is the surface opposing the faucet. The front of the bathtub is the surface that a bather steps over to enter the bathtub.

19 Claims, 5 Drawing Sheets

VESSEL WITH RECESSED SOAP DISH AND INTEGRATED OVERFLOW DRAIN

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to bathtubs and sinks.

Description of the Related Art

Vessels for holding wash water, such as bathtubs and sinks, have countless designs. These designs all share several functional features. The vessels have an inside wall that holds the liquid. A drain, which is also referred to as a primary drain, is at the lowest part of the vessel. The drain is closed to fill the vessel and opened to drain the vessel.

To prevent the vessel from being overflowed, the vessel includes an overflow drain. The overflow drain is located on the inside wall at a level above the primary drain. The overflow drain is connected to the primary drain. If the vessel is overfilled, the water spills into the overflow drain rather than out the top of the vessel. In sinks, overflow drains are typically placed in the wall opposite from the faucet. In bathtubs, overflow drains are typically placed on the inside wall beneath the faucet.

A soap dish is a tray for holding a bar of soap. Typically, a soap dish is placed on the edge of a bathtub or sink. The soap dish itself is considered unsightly by many. The appearance of the soap dish is worsened when a used bar of soap and lather is placed on the soap dish. When enough lather pools in the soap dish, the lather spills over onto the bathtub or sink and makes an unsightly mess that needs to be cleaned.

In light of these issues with the prior art, a need exists for a soap dish that is both hidden and that does not require draining.

BRIEF SUMMARY OF THE INVENTION

An object of the invention is to provide a vessel for holding liquids with a recessed soap dish and overflow drain that overcomes the disadvantages of the devices of this general type and of the prior art.

With the foregoing and other objects in view there is provided, in accordance with the invention, a vessel for holding liquid with a soap dish recessed in the vessel's inside wall and with a drain connected to the trap.

The vessel includes an enclosed inside wall for holding the liquid. The inside wall of the vessel can be shaped generally like any existing bathtub or sink. For example, the inside wall can be a single hemispherical surface in the case of a sink bowl or be made of several connected faces as in a rectangular frustum shaped bathtub.

The soap dish is a recessed cavity formed in the inside wall. To create the cavity, an opening is provided in the inside wall. A cavity wall is recessed within the inside wall and is connected to the inside wall. The cavity wall encloses the opening to define the soap dish cavity within said internal wall. The cavity is configured to receive a bar of soap.

An overflow drain hole is formed in the cavity wall. The overflow drain hole is connected to an overflow drainpipe of the vessel. The overflow drainpipe is connected to the primary drain of the vessel.

The overflow drain hole has the usual purpose of limiting how high the vessel can be filled in order to prevent the vessel from overflowing. By placing the overflow drain hole within the soap dish recess, the overflow drain holes are hidden from sight.

The overflow drain hole has the additional function of draining lather and water from a bar of soap after the soap has been used.

The soap dish should be sized to be large enough to receive a typical bar of soap, plus leave room for a user to be able to reach into the cavity to grab the bar of soap. A typical bar of soap is 0.1 kg. The dimensions of the bar of soap are typically 6.5 cm×8 cm×2.5 cm. Accordingly, the dimensions of the recess must be at least large enough to receive the bar of soap.

The overflow drain holes in the soap dish should be small enough to prevent the bar of soap from falling down the overflow drain. Accordingly, the drain holes should be smaller than 2.5 cm across. In addition, because the size of the soap bar decreases as the bar of soap is used, the size of the drain holes should be even less.

The vessel according to the invention typically will have a primary drain at the bottom of the inside wall. The drain is closed to fill the vessel. To allow the vessel to fill, the overflow drain should be higher than the primary drain of the vessel.

A further object of the invention is to provide a vessel with a recessed soap dish that is hidden from a person standing before the sink. The front of the sink can be identified as the location that is opposite the sink faucet. The sink can include a countertop with cutouts for the faucet. The soap dish is then located opposite the faucet within the vessel's inside wall. In this way, the soap and lather on the soap are hidden from an observer who is standing in front of the sink.

In a bathtub embodiment, the soap dish cavity can be formed on the front of the bathtub. The front of the bathtub is defined as the edge of the bathtub that the bather steps over to enter the bathtub. By placing the soap dish cavity on the front of the bathtub's inside wall, the soap dish cavity is hidden from the view of observers in the room.

A further object of the invention is to provide a soap dish with a flat, horizontal bottom. The flat bottom of the soap dish provides a surface on which the soap rests so the soap does not fall from the soap dish into the vessel. While the bottom of the soap dish is generally flat, additional bumps and skids can be added to provide a surface on which the soap can rest an under which overflowing water can flow.

The drain hole or holes can be formed in the flat bottom of the soap dish. By locating the drain holes in the bottom of the soap dish, the rising water in the tub spills over the bottom of the soap dish and into the overflow drain.

In accordance with the objects of the invention, the cavity can be rectangular-prism shaped. By being rectangular shaped, a rectangular bar of soap can fit within the cavity.

A further object of the invention is to provide an overflow drain that can be unclogged easily. To meet this object, a perforated metal grate can be placed on the bottom of the soap dish over the overflow drain hole.

A further object of the invention is to provide a vessel with a recessed soap dish that also is an overflow drain. To meet these objects, the opening of the soap-dish cavity must be wider than the widest dimension of a bar of soap that is to be held. A cavity that is wider than 8.3 centimeters should be wide enough to receive a typical bar of soap. In addition, the overflow drain hole formed in the cavity wall needs to be narrower than the narrowest dimension of the bar of soap. By being narrower than the bar of soap, the bar of soap cannot slip into the overflow drain. A drain hole that is narrower than 2.5 centimeters is narrower enough to prevent a typical bar of soap from falling into the overflow drain.

Other features that are considered as characteristic for the invention are set forth in the appended claims.

Although the invention is illustrated and described herein as embodied in a vessel with recessed soap dish and integrated overflow drain, the invention should not be limited to the details shown in those embodiments because various modifications and structural changes may be made without departing from the spirit of the invention while remaining within the scope and range of equivalents of the claims.

The construction and method of operation of the invention and additional objects and advantages of the invention is best understood from the following description of specific embodiments when read in connection with the accompanying drawings.

DETAILED DESCRIPTION OF THE INVENTION

Figure 1:
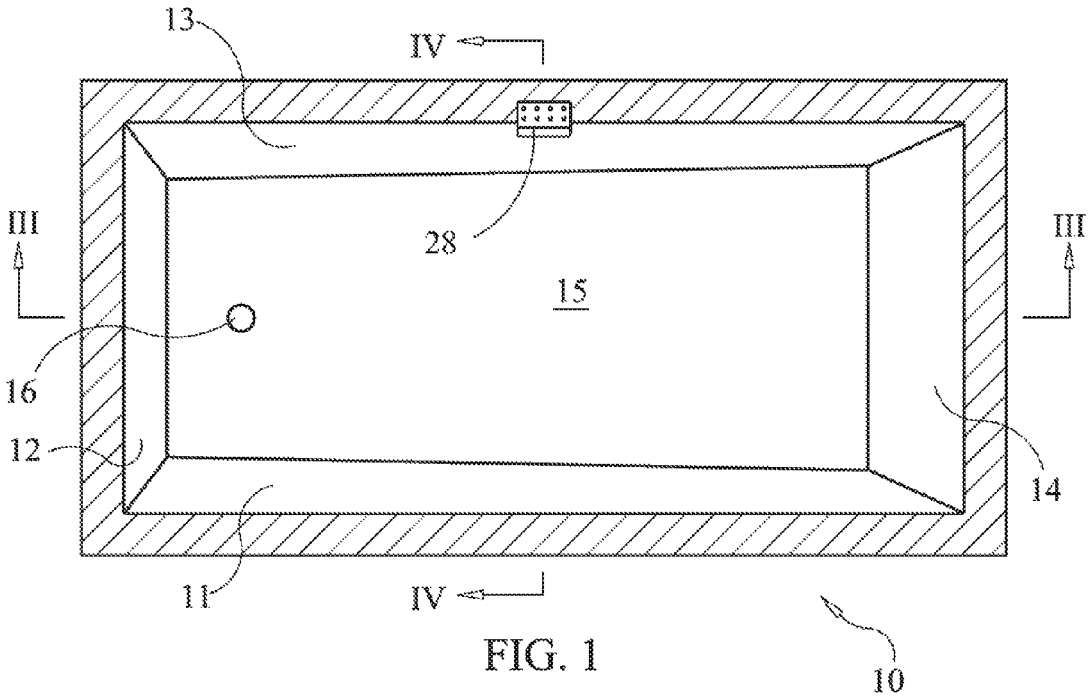
FIG. 1 is a sectional top side view of a bathtub according to the invention, taken along line I-I in FIG. 2.
Figure 2:
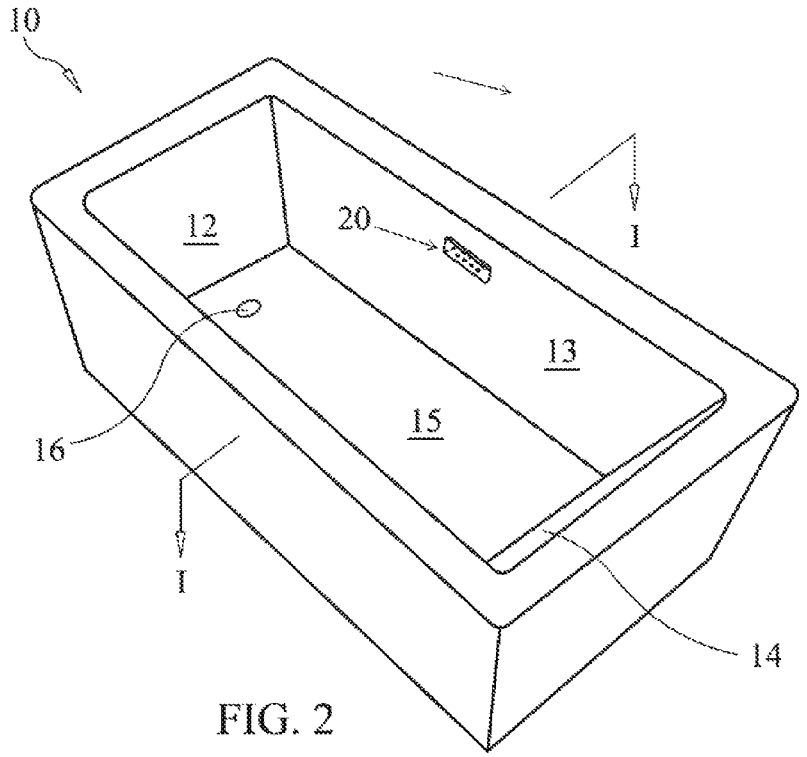
FIG. 2 is a perspective view of the bathtub shown in FIG. 1.
Figure 3:
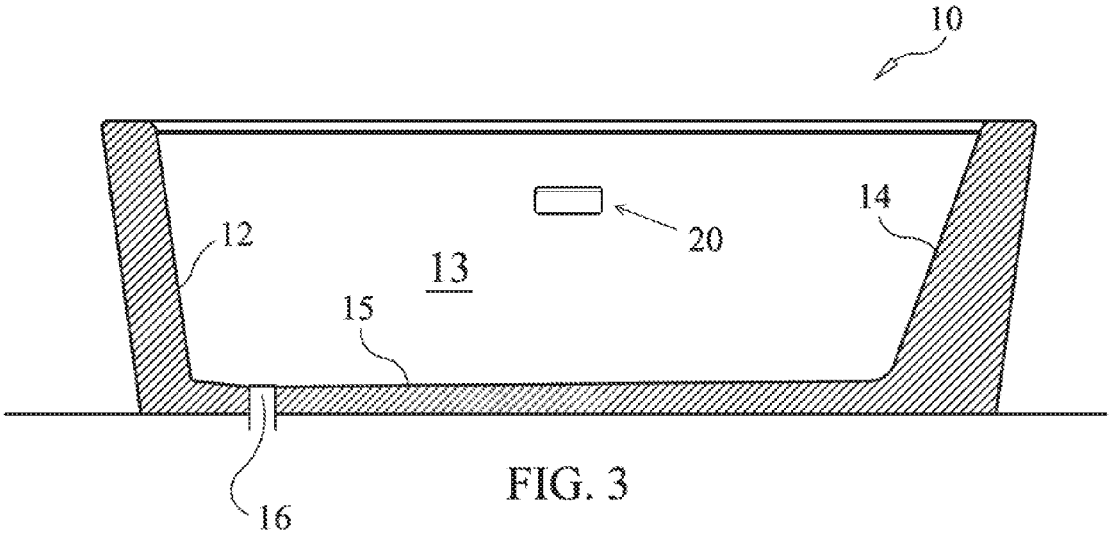
FIG. 3 is a rear sectional view of the bathtub taken along line III-III in FIG. 1.

FIGS. 1-5 show a first preferred embodiment of the invention: a bathtub with a recessed soap dish and overflow drain. The bathtub is generally marked with reference number 10. The embodiment shown has an inside wall that is a rectangular frustum. Other shapes are possible such as conical frustrums and bowl shapes. The inside wall is formed by a rear wall 11, a left wall 12, a front wall 13, a right wall 14, and a bottom 15. A primary drain hole 16 is formed in the bottom 15. The bottom 15 slopes downward toward the primary drain hole 16.

A soap dish 20 is recessed in the front wall 13. The soap dish 20 is formed behind an opening in the front wall 13. In the preferred embodiment, the opening 20 is rectangular and the cavity is a rectangular prism. A cavity wall is recessed in the front wall 13 to define a cavity of the soap dish 20. The cavity wall is formed by the left-side soap-dish wall 22, the right-side soap-dish wall 24, the soap-dish top 25, and the soap-dish rear 26.

The size of the soap-dish 20 is large enough to receive a typical, 0.1 kg, sized bar of soap. The soap-dish rear 26 is preferably ten centimeters (10 cm) wide. The right side soap-dish wall 24 and the left side soap-dish wall 22 are preferably eight centimeters (8 cm) deep. The soap-dish rear 26, the right side soap-dish wall 24, and the left side soap-dish wall are preferably five centimeters (5 cm) high. An indentation 23 is added along the soap-dish-top 25 for decoration.

Figure 4:
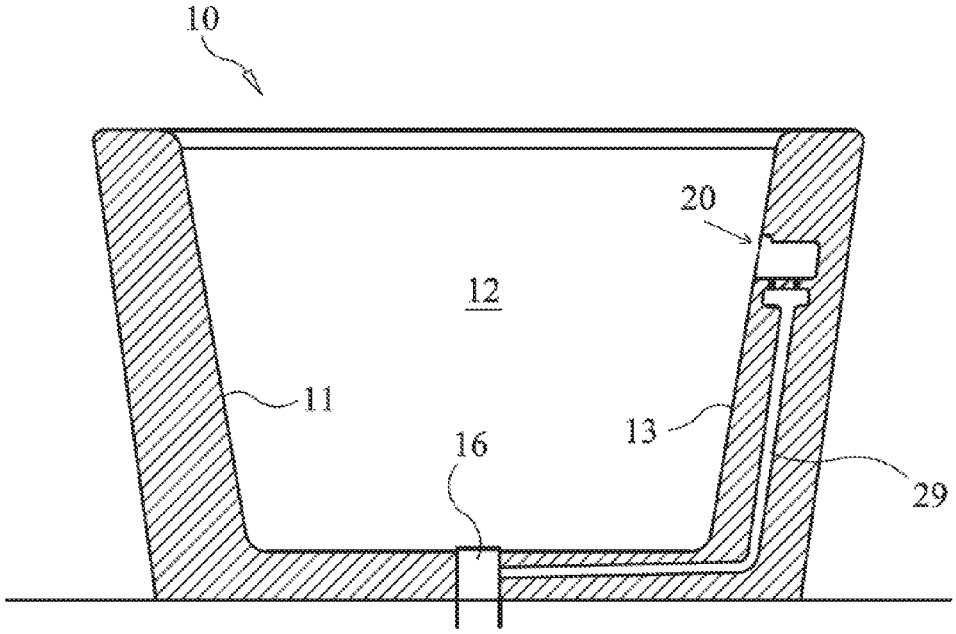
FIG. 4 is a right side section view of the bathtub shown in FIG. 1 taken along line IV-IV.
Figure 5:
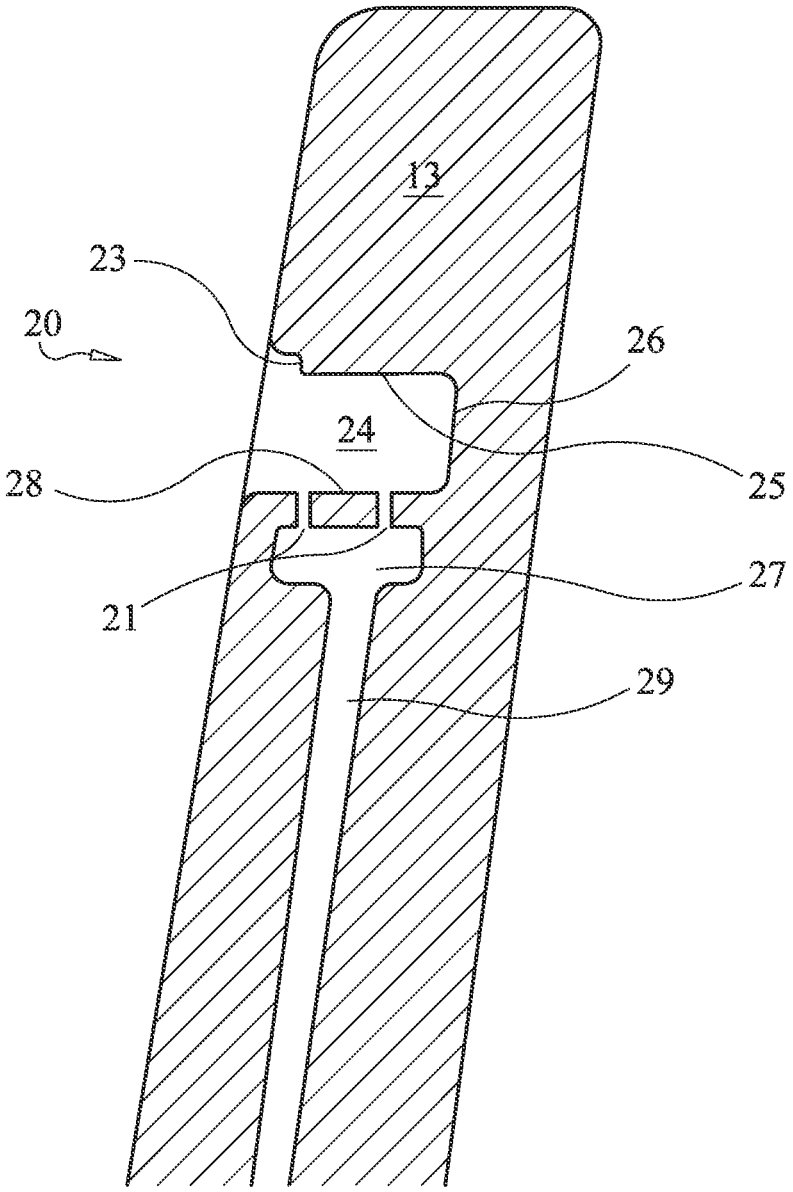
FIG. 5 is a partial view of the bathtub shown in FIG. 4.
Figure 6:
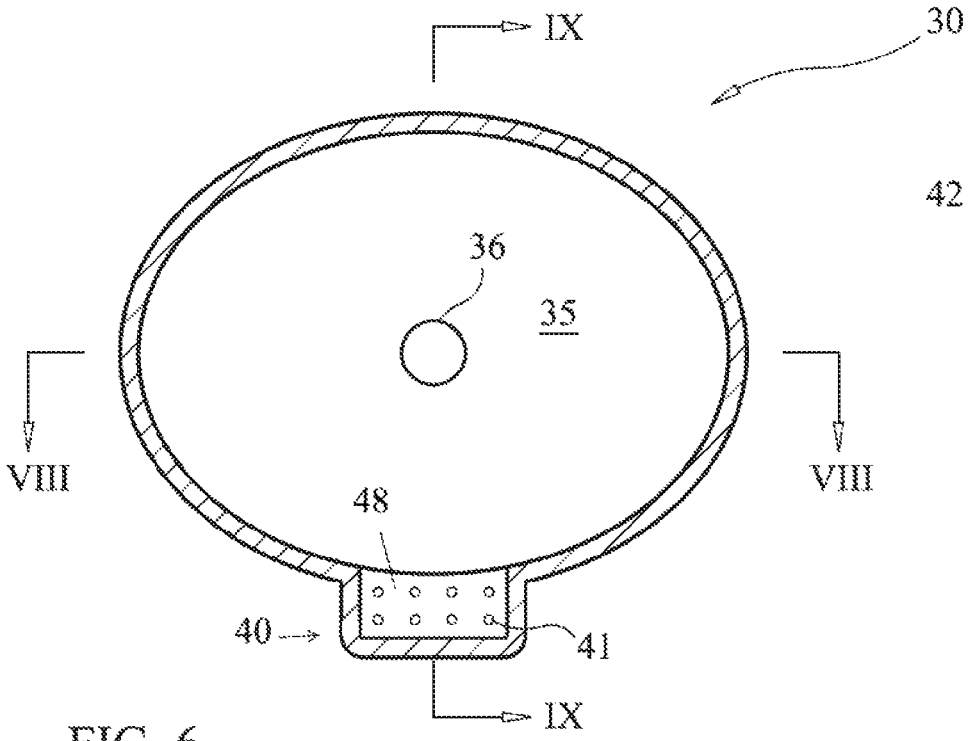
FIG. 6 is a top sectional view of a sink taken along line VI-VI in FIG. 7.

As shown in FIGS. 4 and 5, overflow drains holes 21 are formed in the tray 28. The overflow drain holes 21 are preferably narrower than the smallest dimension of a 0.1 kg bar of soap. The overflow drain holes 21 are narrower than 2.5 cm and more preferably 3 mm wide. A soap-dish basin 27 is beneath the tray 28. An overflow drain 29 connects the soap-dish basin 27 to the primary drain 16.

The tray 28 is preferably a perforated metal plate. The metal plate is removable to allow the overflow drain 49 to be cleared.

The soap dish 20 is preferably recessed within the front wall 13 of the bathtub 10. The front wall 13 is functionally defined as the side over which a user steps to enter the bathtub 10. By placing soap-dish 20 in the front wall 13, the soap dish 20 is not visible from outside the bathtub 10.

FIGS. 6-9 show a second preferred embodiment of the invention: a sink 30 with a recessed soap dish 40 that is connected to an overflow drain 41.

Figure 7:
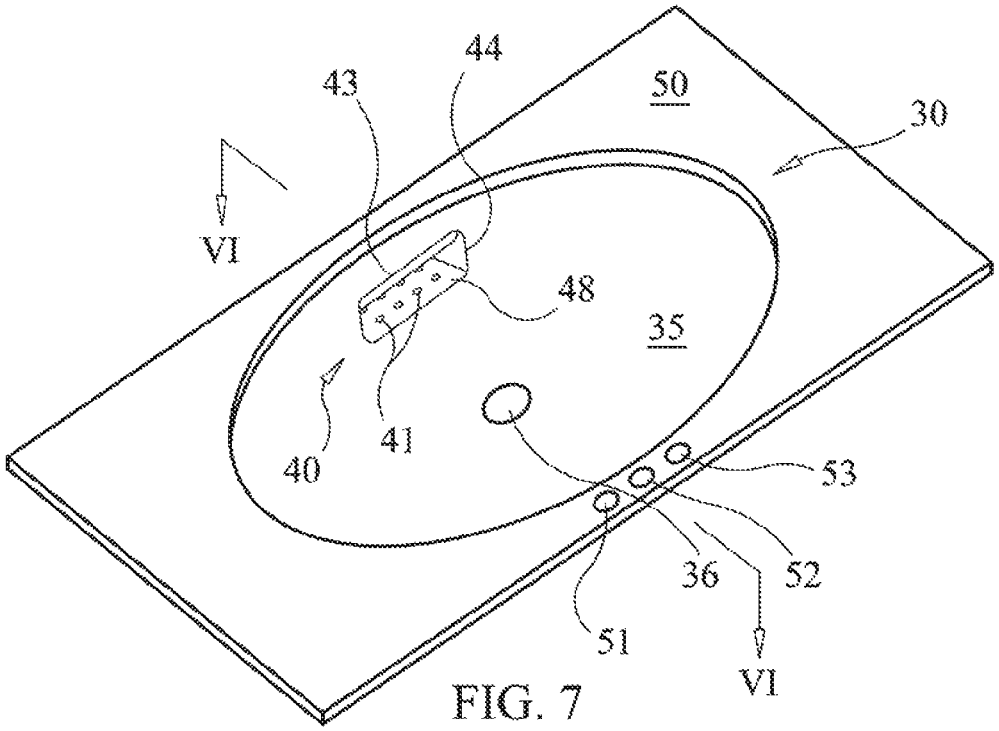
FIG. 7 is a perspective view of the sink shown in FIG. 6.
Figure 8:
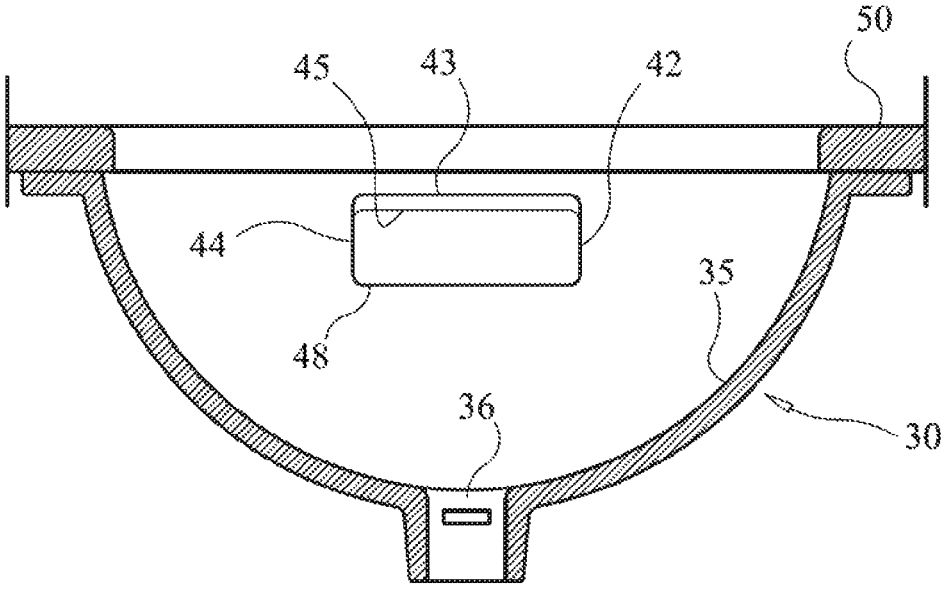
FIG. 8 is a rear sectional view of the sink shown in FIG. 6 taken along line VIII-VIII.
Figure 9:
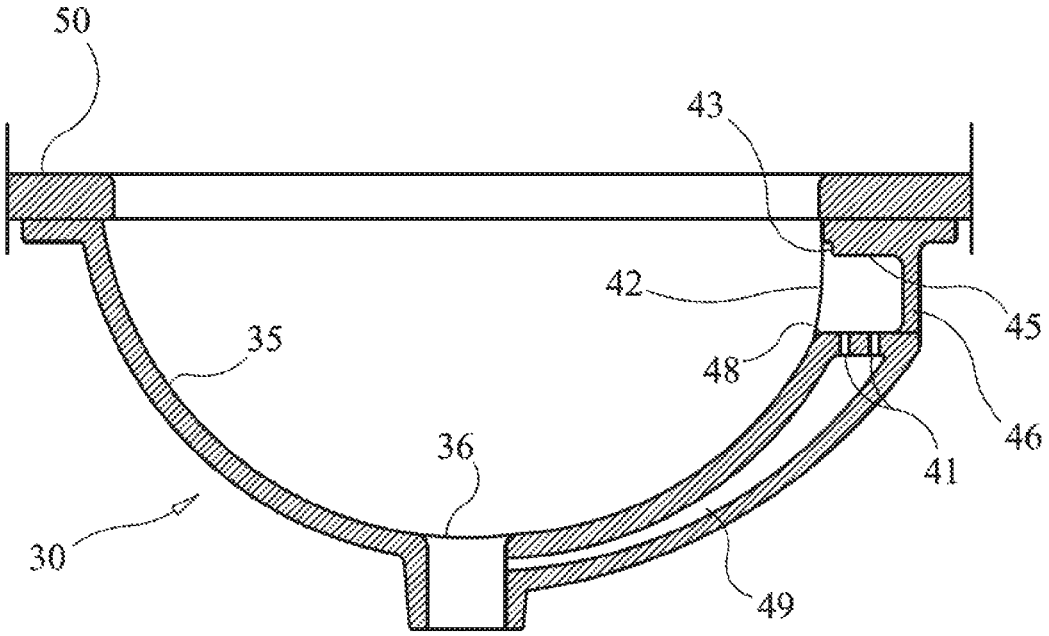
FIG. 9 is a right side sectional view of the sink shown in FIG. 6 taken along line IX-IX.

FIG. 7 shows the sink 30. The sink 30 is bowl shaped and includes an inside wall 35. A primary drain hole 36 is formed in the bottom of the inside wall 35. A countertop 50 is placed over the rim of the sink 30. The countertop 50 has a cold water cutout 51 for installing a cold-water valve, a hot water cutout 53 for installing a hot-water valve, and a faucet cutout 52 for installing a faucet.

The soap dish 40 is recessed in the inside wall 35 of the sink 30. The soap dish 40 is formed behind an opening made within the inside wall 35. In the preferred embodiment, the opening of the soap dish 40 is rectangular and the cavity is a rectangular prism. A cavity wall is recessed in the inside wall 35 of the sink 30 to define a cavity of the soap dish 40. The cavity wall is formed by the left-side soap-dish wall 42, the right-side soap-dish wall 44, the soap-dish top 45, and the soap-dish rear 46.

The size of the soap-dish 40 is large enough to receive a typical, 0.1 kg, sized bar of soap. The soap-dish rear 46 is preferably ten centimeters (10 cm) wide. The right side soap-dish wall 44 and the left side soap-dish wall 42 is preferably eight centimeters (8 cm) deep. The soap-dish rear 46, the right side soap-dish wall 44, and the left side soap-dish wall are preferably five centimeters (5 cm) high. An indentation 43 is added along the soap-dish-top for decoration.

The overflow drains holes 41 are formed in the tray 48. The overflow drain holes 41 are preferably narrower than the smallest dimension of a 0.1 kg bar of soap. The overflow drain holes 41 are narrower than 2.5 cm and more preferably 3 mm wide. A soap-dish basin 47 is beneath the tray 48. An overflow drain 49 connects the soap-dish basin 47 to the primary drain 36.

The tray 48 is preferably a perforated metal plate. The metal plate is removable to allow the overflow drain 49 to be cleared.

The soap dish 40 is preferably recessed within the front of the sink 30. The rear of the sink is where the cold-water cutout 51, faucet cutout 52, and hot-water cutout 53 are located. By placing the soap-dish 40 in the front of the sink 30, the soap dish 40 is not visible from the front of the sink 30.

While examples of the invention are shown in the preferred embodiments, the preferred embodiments should not be read as limits to the invention as described in the claims.

What is claimed is:

1. A vessel for holding liquid, comprising:

an internal wall having an opening formed therein and having a drain hole formed therein;

a cavity wall connected to said internal wall and enclosing said opening to define a cavity within said internal wall, said cavity being configured to receive a bar of soap;

an overflow drain hole formed in said cavity wall for allowing the liquid to egress, said drain hole being narrower in at least one dimension than said opening;

a drain being disposed beneath said inner wall, said drain being connected to said drain hole, and said drain being configured to connect to a drain pipe; and an overflow drain interconnecting said overflow drain hole and said drain, said overflow drain being outside said internal wall.

2. The vessel according to claim 1, wherein said drain hole is located lower than said overflow drain hole.

3. The vessel according to claim 1, further comprising a top surface, said top surface extending outward from said internal wall, said top surface having a faucet cutout formed therein for receiving a faucet, said faucet cutout opposing said cavity wall.

4. The vessel according to claim 1, wherein said cavity is rectangular-prism shaped.

5. The vessel according to claim 1, wherein said cavity has a flat bottom.

6. The vessel according to claim 5, wherein said drain hole is formed in said flat bottom.

7. The vessel according to claim 1, further comprising a tray disposed in said cavity and covering said drain hole.

8. The vessel according to claim 7, wherein said tray has a hole formed therein.

9. The vessel according to claim 7, wherein said tray is made of metal.

10. The vessel according to claim 2, wherein said cavity is disposed on said inside wall laterally with respect to said further drain hole.

11. The vessel according to claim 1, wherein a plurality of drain holes are formed in said cavity wall for allowing the liquid to egress, said drain holes being narrower in at least one dimension than said opening.

12. A vessel for holding liquid, comprising:

an internal wall having an opening formed therein and having a drain hole formed therein;

a cavity wall connected to said internal wall and enclosing said opening to define a cavity within said internal wall, said cavity being wider than a dimension of a bar of soap;

an overflow drain hole formed in said cavity wall for allowing the liquid to egress, said drain hole being narrower than the dimension of the bar of soap;

a drain being disposed beneath said inner wall, said drain being connected to said drain hole, and said drain being configured to connect to a drain pipe; and an overflow drain interconnecting said overflow drain hole and said drain, said overflow drain being outside said internal wall.

13. The vessel according to claim 12, wherein said cavity is wider than a widest dimension of the bar of soap.

14. The vessel according to claim 13, wherein said cavity is wider than 8.3 centimeters.

15. The vessel according to claim 12, wherein said cavity is deeper than a widest dimension of the bar of soap.

16. The vessel according to claim 15, wherein said cavity is wider than 8.3 centimeters.

17. The vessel according to claim 12, wherein said drain hole is narrower than a narrowest dimension of the bar of soap.

18. The vessel according to claim 17, wherein said drain hole is narrower than 2.5 centimeters.

19. In a vessel for holding liquid that includes an internal wall with a primary drain hole formed therein, an overflow drain hole formed therein, a drain connected to said primary drain hole, and an overflow drain interconnecting said overflow drain hole and said drain, the improvement comprising:

an opening formed in the internal wall; and a cavity wall connected to said internal wall and enclosing said opening to define a cavity within said internal wall, said cavity being wider than a dimension of a bar of soap, and said cavity being configured to receive a bar of soap;

said overflow drain hole being formed in said cavity wall, and said overflow drain being narrower than the dimension of a bar of soap.

* * * * *